US006196868B1

(12) United States Patent
Juntwait

(10) Patent No.: US 6,196,868 B1
(45) Date of Patent: Mar. 6, 2001

(54) CABLE ASSEMBLY WITH INSULATION DISPLACEMENT CONTACTS FOR GROUNDING

(75) Inventor: Eric Juntwait, Irvine, CA (US)

(73) Assignee: Hon Hai Aprecision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/222,236

(22) Filed: Dec. 28, 1998

(51) Int. Cl.[7] ..... H01R 12/24
(52) U.S. Cl. ..... 439/497; 439/492
(58) Field of Search ..... 439/492–497; 29/858, 861, 866, 829

(56) References Cited

U.S. PATENT DOCUMENTS 4,824,394 * 4/1989 Roath et al. ..... 439/395
5,967,832 * 10/1999 Ploehn ..... 439/497

* cited by examiner

*Primary Examiner*—Lincoln Donovan
*Assistant Examiner*—Chandrika Prasad
(74) *Attorney, Agent, or Firm*—Wei Te Chung

(57) ABSTRACT

A cable assembly comprises an IDC connector including a dielectric housing having front and rear faces. An array of passageways is defined between the front and rear faces. Each passageway securely receives a terminal therein. Each terminal forms an insulation displacement section extending beyond the rear face and a pin section extending beyond the front face. A cover is assembled to the rear face. A row of ground contacts is assembled to a top face of the cover. Each ground contact has a tip and an insulation displacement section at opposite end thereof. A ground plane cable is assembled to the housing by means of the cover. The cable includes a plurality of signal and ground conductors terminating at the insulation displacement sections of the terminals, wherein a ground plane of the cable electrically connects with the tips of the ground contacts when the cable is fed around the IDC connector.

6 Claims, 3 Drawing Sheets

CABLE ASSEMBLY WITH INSULATION DISPLACEMENT CONTACTS FOR GROUNDING

FIELD OF THE INVENTION

The present invention relates to a connector, and more particularly to an IDC connector having additional ground contacts for contacting a ground plane of a cable thereby ensuring reliable signal transmission.

DESCRIPTION OF PRIOR ART

As the speed of signal transmission through a cable assembly increases, the need to isolate and protect the signals from electrical noise becomes important. One existing method for achieving this is performed by using a ground plane ribbon cable which includes a ground plane attached to conductive wires. The ground plane acts as a barrier to shield the signal within the conductive wires from being adversely affected by noise. In addition, a certain number of conductive wires within the cable are grounded to ensure reliable signal transmission.

SUMMARY OF THE INVENTION

An objective of this invention is to provide an IDC connector having additional ground contacts for contacting a ground plane of a cable thereby ensuring reliable signal transmission.

In order to achieve the objective set forth, a cable assembly comprises an IDC connector including a dielectric housing having front and rear faces. An array of passageways is defined between the front and rear faces. Each passageway securely receives a terminal therein. Each terminal forms an insulation displacement section extending beyond the rear face and a pin section extending beyond the front face. A cover is assembled to the rear face. A row of ground contacts is assembled to a top face of the cover. Each ground contact includes a connecting section and an insulation displacement section at opposite ends thereof. A ground plane cable is assembled to the housing by means of the cover. The cable includes a plurality of signal and ground conductors terminating at the insulation displacement sections of the terminals, wherein a ground plane of the cable electrically connects with the connecting sections of the ground contacts when the cable is fed around the IDC connector.

BRIEF DESCRIPTION OF DRAWINGS

The present invention will be apparent to those skilled in the art by reading the following description of the preferred embodiment thereof, with reference to the accompanying drawing, in which.

DETAILED DESCRIPTION OF PREFERRED EMBODIMENT

Figure 1:
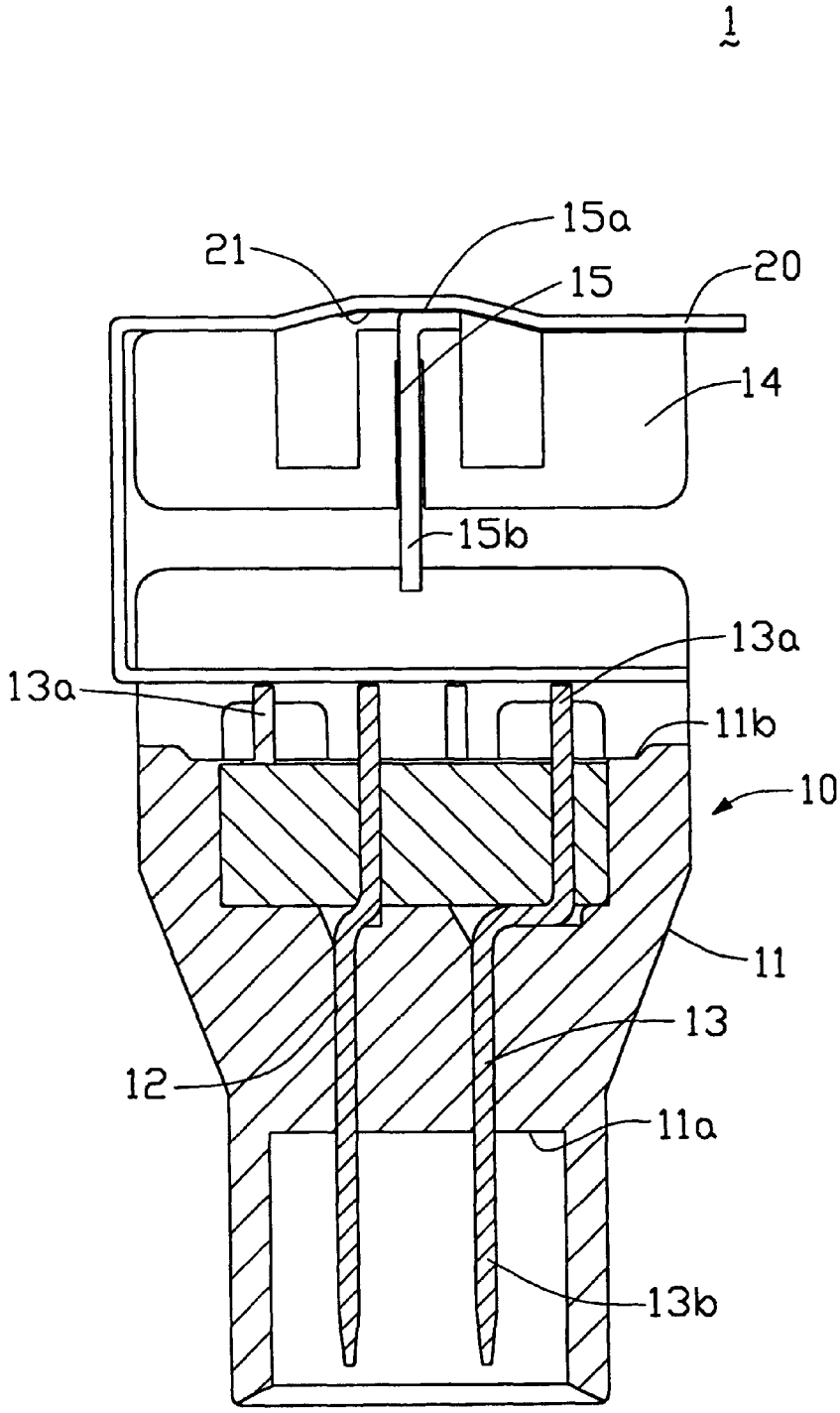
FIG. 1 is a cross sectional view of an IDC connector ready for assembling in accordance with the present invention.
Figure 3:
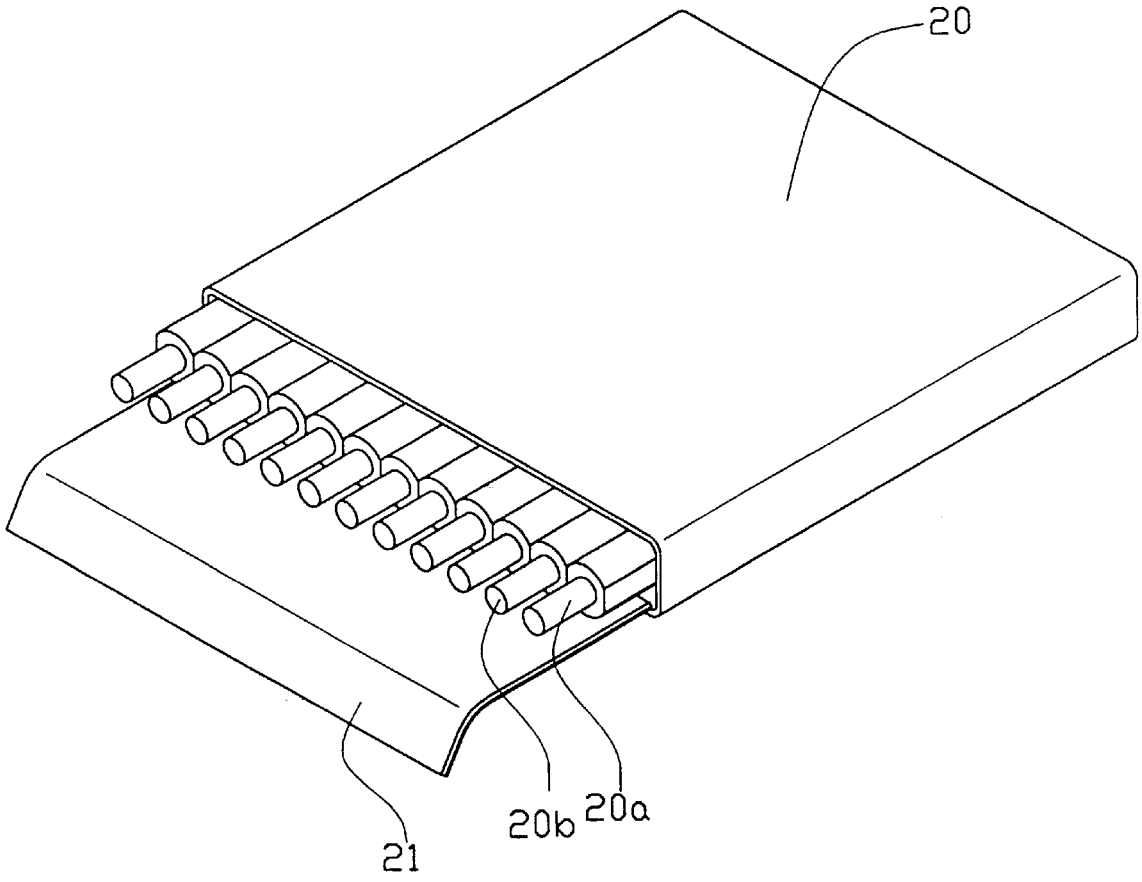
FIG. 3 is a perspective view of a ground plane cable.

Referring to FIGS. 1 and 3, a cable assembly 1 in accordance with the present invention comprises an IDC connector 10 including a dielectric housing 11 having front and rear faces 11*a*, 11*b*. An array of passageways 12 is defined between the front and rear faces 11*a*, 11*b*. Each passageway 12 securely receives a terminal 13 therein. Each terminal 13 forms an insulation displacement section 13*a* extending beyond the rear face 11*b* and a pin section 13*b* extending beyond the front face 11*a*.

A cover 14 is assembled to the rear face 11*b* of the housing 11. A row of ground contacts 15 is assembled to the cover 14. Each ground contact 15 has a tip 15*a* extending beyond a top face of the cover 14 and an insulation displacement section 15*b* extending beyond a bottom face of the cover 14.

A ground plane cable 20 is assembled to the IDC connector 11 by means of the cover 14. The ground plane cable 20 includes a plurality of signal and grounding wires 20*a*, 20*b* each aligned with a corresponding insulation displacement section 13*a*, and a ground plane 21. Termination between the cable 20 and the insulation displacement sections 13*a* is facilitated by the cover 14 which is assembled to the housing 11. Simultaneously, termination between the grounding wires of the cable 20 and the insulation displacement section 15*b* of the ground contacts 15 is achieved by assembling the cover 14 to the housing 11. When the cable 20 is wrapped over the cover 14, the tips 15*a* of the ground contacts 15 contact a ground plane 21 thereby facilitating a complete grounding path between the cable 20 and the connector 10. Quality of signal transmission within the cable 20 and the connector 10 is therefore ensured.

Figure 2:
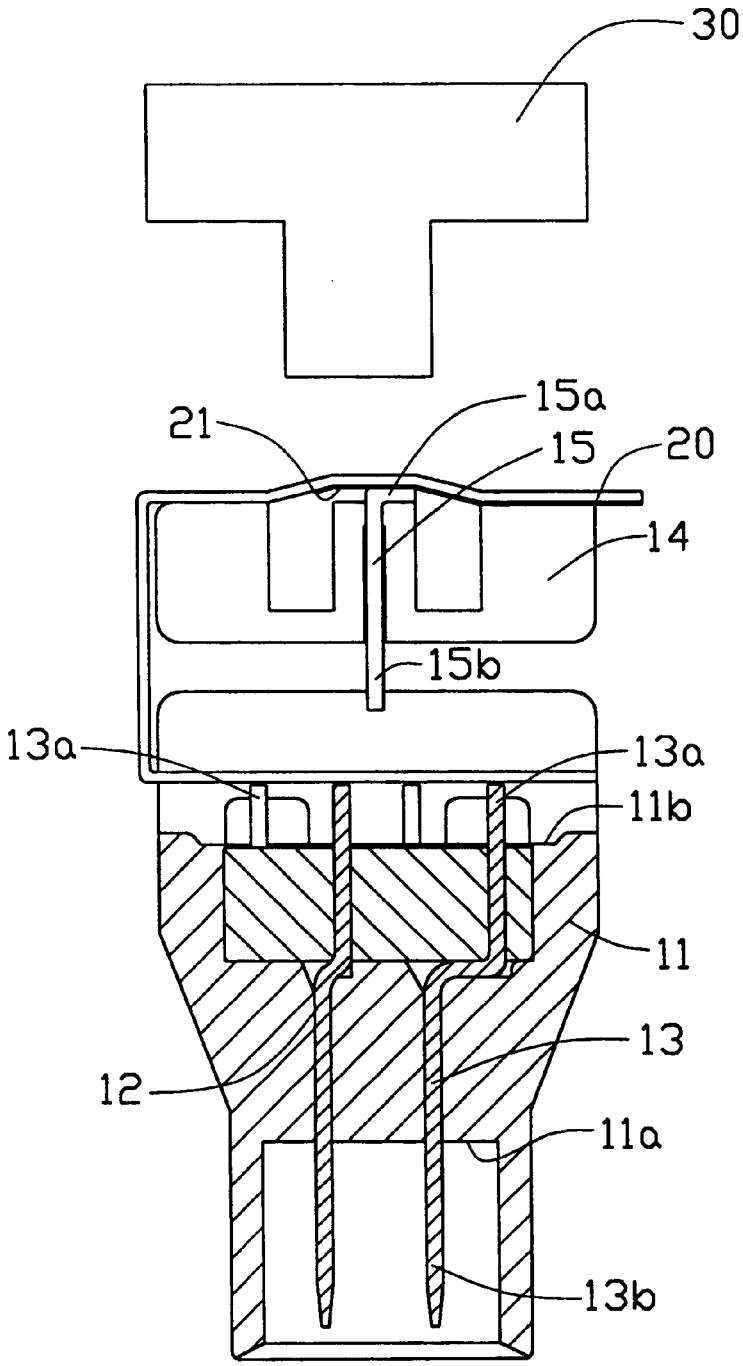
FIG. 2 is a cross sectional view of the IDC connector with a strain relief assembled thereto.

Referring to FIG. 2, a strain relief 30 is assembled to the cover 14 thereby providing sufficient contact force between the ground plane 21 and the additional ground contacts 15. Since the strain relief 30 is known to those skilled in the art, a detailed description thereof is omitted herein.

Although the present invention has been described with reference to a preferred embodiment thereof, it is apparent to those skilled in the art that a variety of modifications and changes may be made without departing from the scope of the present invention which is intended to be defined by the appended claims.

I claim:

1. A cable assembly, comprising:

an insulation displacement contact connector, including:

a dielectric housing having front and rear faces, an array of passageways defined between said front and rear faces, each passageway securely receiving a terminal therein, each said terminal forming an insulation displacement section extending beyond said rear face and a pin section extending beyond said front face;

a cover assembled to said rear face of said housing, a row of ground contacts being assembled to a top face of said cover, each said ground contact having a tip and an insulation displacement section at opposite ends thereof; and a ground plane cable being assembled to said housing by means of said cover, said cable including a plurality of conductors terminating at said insulation displacement sections of said terminals;

wherein a ground plane of said cable mechanically and electrically connects with said tips of said ground contacts when said cable is fed around said insulation displacement contact connector.

2. The cable assembly as recited in claim 1, wherein a strain relief is assembled to said housing thereby providing sufficient contact force between said ground plane and said additional ground contacts.

3. A cable assembly comprising:

an insulation displacement contact connector including a dielectric housing defining front and rear faces, a plurality of terminals extending between said front and said rear faces, each of said terminals including an insulation displacement section around said rear face; and a cover attached to the rear face of the housing, a plurality of ground contacts positioned around the cover, each of said ground contacts including an insulation displacement section and a tip; and a cable including a plurality of wires, and a grounding plane; whereby termination between the insulation displacement sections of the terminals and the cable and between the insulation displacement sections of the ground contacts and the grounding wires of the cable can simultaneously achieved by assembling the cover to the housing;

wherein said tip of each of the ground contact extends out of a top face of the cover and said insulation displacement section of the ground contact extends out of a bottom face of the cover.

4. The cable assembly as recited in claim 3, wherein the tip of each of the ground contact can electrically connected to the grounding plane of the cable when a strain relief is assembled to the housing for sandwiching said cable therebetween.

5. A method of grounding some specific conductors of a cable, comprising the steps of:

providing an insulation displacement contact connector, said connector defining front and rear faces;

providing a plurality of terminals within the connector, each of said terminals including an insulation displacement section thereof;

providing said cable with a plurality of conductors and a grounding plane;

providing a plurality of ground contacts, each of said ground contacts including an insulation displacement section;

terminating the insulation displacement sections of the terminals to the conductors of the cable;

terminating the insulation displacement sections of the ground contacts to some specific conductors of the cable; and electrically connecting said ground contacts to the grounding plane.

6. The method as recited in claim 5, wherein terminating the terminals and the ground contacts to the cable occur simultaneously.

* * * * *